US007805791B2

(12) United States Patent
Malzl

(10) Patent No.: US 7,805,791 B2
(45) Date of Patent: Oct. 5, 2010

(54) SECTIONAL ELEMENT MAT

(75) Inventor: Hans L. Malzl, Eugendorf (AT)

(73) Assignee: Das Gesundheitshaus GESMBH & Co. KG, Salzburg (AT)

( * ) Notice: Subject to any disclaimer, the term of this patent is extended or adjusted under 35 U.S.C. 154(b) by 0 days.

(21) Appl. No.: 11/816,838

(22) PCT Filed: Jan. 17, 2006

(86) PCT No.: PCT/AT2006/000023

§ 371 (c)(1),
(2), (4) Date: Aug. 22, 2007

(87) PCT Pub. No.: WO2006/089318

PCT Pub. Date: Aug. 31, 2006

(65) Prior Publication Data

US 2008/0201860 A1 Aug. 28, 2008

(30) Foreign Application Priority Data

Feb. 22, 2005 (AT) ..... A 298/2005

(51) Int. Cl.
*A47C 17/00* (2006.01)

(52) U.S. Cl. ..... 5/727; 5/724; 5/722

(58) Field of Classification Search ..... 5/727, 5/724, 722, 730, 740, 729, 701, 613, 640, 5/643, 636
See application file for complete search history.

(56) References Cited

U.S. PATENT DOCUMENTS 4,122,568 A * 10/1978 Bastos et al. ..... 5/690
4,628,557 A * 12/1986 Murphy ..... 5/723
4,639,960 A * 2/1987 Quillen et al. ..... 5/710
4,706,313 A * 11/1987 Murphy ..... 5/722

(Continued)

FOREIGN PATENT DOCUMENTS

DE 2339645 2/1975

(Continued)

OTHER PUBLICATIONS

Machine Translation of JP 2005334418A1, Dec. 2005.*
JP 2002-34726 Machine Translation.*

*Primary Examiner*—Robert G Santos
*Assistant Examiner*—Brittany M Wilson
(74) *Attorney, Agent, or Firm*—MacCord Mason PLLC

(57) ABSTRACT

The invention relates to a sectional element mat (2), the support properties of which may be individually tailored, whereby exchangeable sectional elements (E) are arranged tightly together or above each other. The above is characterized in that the individual sectional elements (E) may be easily removed and exchanged with other sectional elements. The individual sectional elements are either connected to each other by means of a separable material bridge or perforation (5, 6), connected to each other by means of a plug connector (27, 31), plugged onto or into a common base mat (40) or lying loose on the same. Individual sectional elements can be removed or separated from the combination where necessary and replaced by softer or stiffer sectional elements. In certain situations the resulting free space is left empty. The sectional element mat (2) is either part of a combination with other sectional element mats or contiguous or separate layers (1, 3), or itself forms the mattress core.

9 Claims, 4 Drawing Sheets

U.S. PATENT DOCUMENTS

| | | | | | |
|---|---|---|---|---|---|
| 4,768,251 | A | * | 9/1988 | Baskent | 5/722 |
| 4,809,374 | A | * | 3/1989 | Saviez | 5/420 |
| 4,825,488 | A | * | 5/1989 | Bedford | 5/726 |
| 4,843,666 | A | | 7/1989 | Elesh et al. | 5/447 |
| 5,353,455 | A | * | 10/1994 | Loving et al. | 5/730 |
| 5,561,875 | A | * | 10/1996 | Graebe | 5/423 |
| 5,678,266 | A | * | 10/1997 | Petringa et al. | 5/655.5 |
| 6,343,394 | B1 | * | 2/2002 | Gandolfi | 5/690 |
| RE38,135 | E | * | 6/2003 | Stolpmann et al. | 5/740 |
| 2002/0178503 | A1 | * | 12/2002 | Reeder et al. | 5/690 |
| 2003/0221262 | A1 | * | 12/2003 | Torbet et al. | 5/713 |

FOREIGN PATENT DOCUMENTS

| | | | | | |
|---|---|---|---|---|---|
| EP | 1177750 | | | 2/2002 | |
| FR | 2703586 | | | 10/1994 | |
| JP | 2002034726 | | | 2/2002 | |
| JP | 2004049415 | | | 2/2004 | |
| JP | 2005334418 | | * | 12/2005 | 5/636 |
| WO | WO 8102384 | A1 | * | 9/1981 | |
| WO | WO03/101257 | | | 12/2003 | |

* cited by examiner

SECTIONAL ELEMENT MAT

BACKGROUND OF THE INVENTION

The invention relates to a sectional element mat made of sectional elements arranged one beside the other, which preferably form at least one layer of a multi-layer mattress.

It is the task of a mattress to provide optimum support regarding the forces acting on the reclining body, thereby offering a maximum of rest and relaxation to the user. For this reason mattresses are divided into several supporting zones, which are to provide supporting force to individual parts of the body as physiologically required. In previous models, the individual supporting zones were permanently integrated in the mattress, that is, they were built in during manufacture of the mattress. Such mattresses are known as 5- or 7-zone mattresses. In these mattresses, the supporting force of the individual zones and their positions are determined by the average dimensions of the human body and cannot be individually adjusted. After manufacture, changes of the individual supporting zones are not possible. Since the physiological suitability of a mattress can only be judged after prolonged use, a modern mattress must provide the possibility of defining and changing both the supporting force and the position of the individual supporting zones at any time.

Development of such individually designable and modifiable zone mattresses has been going on for some time and mattresses using such technology have reached the market. As a rule the individual tailoring of such mattresses is obtained by making exchangeable, individual elements of the mattress. These early developments are, however, beset with deficiencies and problems. One of these problems usually is that the size of the exchangeable elements is too large and their structuring too coarse. For this reason the individual supporting zones cannot be tailored precisely. A further problem sometimes is due to the fact that exchanging individual supporting elements is impractical for the user.

In this context a single-layer mattress has become known from EP 1 177 750 A1, which consists of a plurality of chain-like coherent elements connected by bonding or by residual links. By breaking the residual links, some elements may be removed and replaced by others.

From JP 2002 034726 A, it is furthermore known to provide a recess in the base of a mattress into which cushion elements with a cover are fitted. Below the cushion elements a firmness regulating means is located, which consists of alternating rigid and flexible foam elements that may be mutually exchanged.

It is the object of the present invention to further improve the technology of individually designable and modifiable zone mattresses made of foamed plastics or latex and above all, to address the above mentioned problems, i.e. provide for finer structuring and easier handling.

The invention achieves its aim by providing sectional elements that are connected to each other or to a base mat in an easily separable way by means of thin material bridges or by interlocking elements, or that the sectional elements are in an easily exchangeable way plugged onto a common base mat or, being interconnected by material bridges, are laid out within boundary elements on a base mat.

According to the invention, the length of the serially arranged sectional elements may extend essentially over the whole width of the sectional element mat, but it is also possible to subdivide the sectional elements both in transverse and longitudinal directions of the sectional element mat.

The invention will now be explained in greater detail with reference to partially schematic drawings. There is shown in:

FIG. 24 is a view from above of the variant of FIG. 23; and

For clarity of presentation of the individual components, the cover of the mattress is omitted.

DETAILED DESCRIPTION OF THE INVENTION

Figure 1:
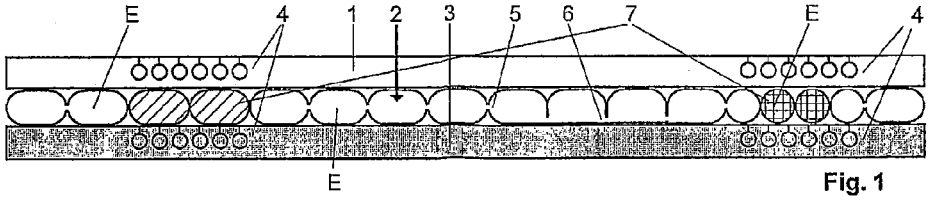
FIG. 1 is a side view of a sectional element mat according to the invention, which is placed between the top and bottom layers of a multi-layer mattress.

FIG. 1 shows a side view of a mattress comprising a continuous upper layer 1, a sectional element mat 2 made of a plurality of partially different sectional elements E, and a lower continuous layer 3. In the area where the shoulders rest, the upper and lower layers have transversely extending chambers 4 of circular cross-section, whose content may be removed if softer bedding is desired. The sectional elements E of the middle-layer sectional element mat 2, are mutually joined by thin material bridges or by perforated links 5,6, where the perforation can be seen either in the middle (see 5) or in the lower part (see 6) of the sectional elements. At certain sites 7 the sectional elements have been taken out and replaced by sectional elements with different material characteristics.

Figure 2:
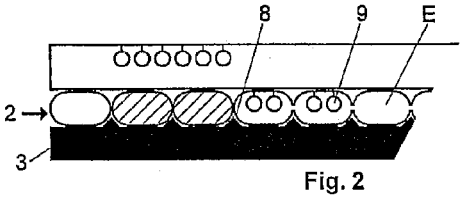
FIGS. 2 to 13 are diverse variants of the sectional element mat, combined with additional, continuous mattress layers or base mats, in a view as in FIG. 1.

FIG. 2 is a side view of a mattress whose sectional element mat 2 locks onto elevations 8, which are provided on the surface of the lower continuous layer 3. There are also shown small round chambers 9 which are formed into the sectional elements E and whose content can be removed.

Figure 3:
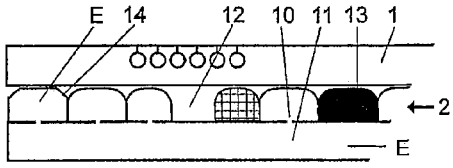

FIG. 3 is a side view of a mattress comprising an upper layer 1, which could also be partitioned, and a sectional element mat 2, whose sectional elements E are connected to an underlying continuous base mat 11 by a material bridge or perforation 10. There can also be seen sites where sectional elements have been disconnected and removed. In one example, the removed sectional element has been replaced by a sectional element 13 having different material characteristics. In another example, the removed element has not been replaced, leaving an empty space 12. T here can also be seen a sectional element with bevelled edges 14.

Figure 4:
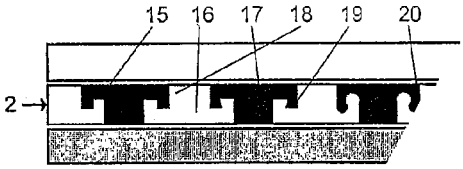

FIG. 4 is a side view of a mattress consisting of an upper and a lower continuous layer, between which a sectional element mat 2 is imbedded, whose sectional elements are plugged together in the form of T-shaped pieces, the gripping nose of one element locking with the gripping nose of the adjacent element. A "lying" element 16 alternates with a "standing" element 17. There can also be seen three different embodiments of the plug-in connection. In one example the gripping noses are rectangular (see 18), in the second example they are tapered (see 19), and the third example shows rounded gripping noses 20.

Figure 5:
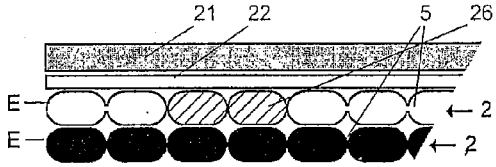

FIG. 5 is a side view of a mattress with a different arrangement of the individual layers. Two continuous layers 21, 22 form the upper region of the mattress, two sectional element mats 2, 2' form the lower part of the mattress; the upper element mat is of softer material (light) whilst the lower element mat is of firmer material (dark). In this example the individual elements of the sectional element mats are mutually connected by perforation 5. Removed sectional elements have been replaced by sectional elements 26 having different material characteristics.

Figure 6:
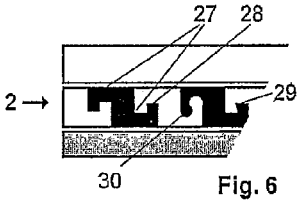

FIG. 6 is a side view of a mattress, where the sectional elements of the sectional element mat 2 are plugged together in the form of S-shaped pieces. Here also the gripping nose 27 of one element locks onto the gripping nose 27 of the adjacent element, the difference being that each element has an upper and a lower gripping nose 27, thus being S-shaped. The gripping noses are shown in rectangular 28, tapered 29, or round 30 configuration.

Figure 7:
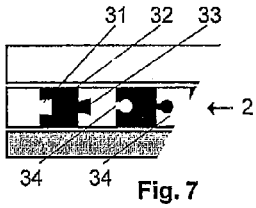

FIG. 7 is a side view of a mattress, where the sectional elements of the sectional element mat 2 are plugged together. The plug-in connection is realized as a tongue-and-groove connection 31. The figure shows three variants of the plug-in connection; a straight variant 32, a variant with tapered tongue 33 and a variant with rounded tongue 34 locking into a groove that is also rounded. Instead of the tongue-and-groove connection, a pin-and-hole connection of the sectional elements E would also be possible.

Figure 8:
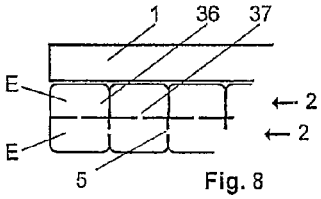

FIG. 8 is a side view of a mattress comprising a continuous layer 1 and a two-layer sectional element mat 36, in which the sectional elements E are placed side by side as well as one above the other. The upper sectional elements E of the sectional element mat 2 are connected to the lower sectional elements E of the sectional element mat 2' by means of a thin material bridge or perforation 37, and the lower sectional elements E are additionally connected to the horizontally adjacent elements via perforation 5.

Figure 9:
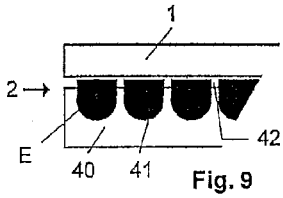

FIG. 9 is a side view of a mattress comprising an upper layer 1 and a lower layer (base mat 40), into which sectional elements E are inserted. The recesses 41 in the base mat are round and receive the rounded lower parts of the sectional elements. These protrude from the base mat 40, creating small ventilation channels 42.

Figure 10:
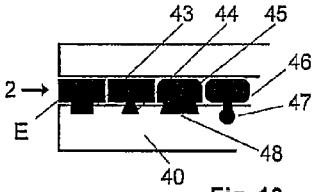

FIG. 10 is a side view of a mattress also comprising an upper layer and a base mat 40. In this case the sectional elements E are plugged into base mat 40, the individual elements being provided with tongues 44 which are engaged in grooves of the base mat. Tongue-and-groove are rectangular in the first example 43, tapered in the second 44, also tapered but wider in the third 48, and with a round head 47 in the fourth. The sectional elements themselves are rectangular in the first and second examples, rounded at the upper edges 45 in the third, and in the fourth example rounded both at the upper and lower edges 46. Instead of the tongue-and-groove connection, a pin-and-hole connection is also possible. The sectional elements E can, for instance, be provided with a pin that can be inserted into a corresponding hole in the base mat.

Figure 11:
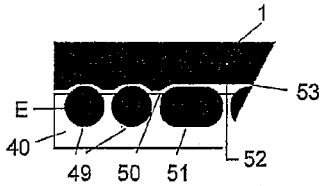

FIG. 11 is a side view of a mattress also comprising an upper layer 1 and a lower base mat 40. In this case the sectional elements E are sunk into the base mat 40. The sectional elements have a circular cross-section as shown in the first two examples (see 49) or an oval cross-section as shown in the third example 51. The sectional elements E protrude from the base mat 40. The mat which is laid on top has elevations 50 at its lower side, lock into the spaces formed between the individual sectional elements. One example also shows the overlay mat with a plane surface 53, where ventilation channels 52 are created between upper and lower layer.

Figure 12:
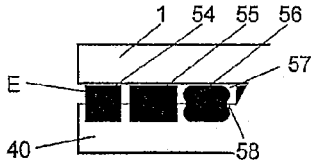

FIG. 12 is a side view of a mattress, again with an upper layer 1 and a lower base mat 40, into which sectional elements E are sunk. The cross-section of the sectional elements is square, as shown in the first example 54, or rectangular as shown in the second example 55. The third example 56 shows a cross-section whose sides are constricted or inwardly bent. The recess in the lower base mat 40 has the same shape of cross-section, thus gripping the inserted sectional elements at the region 58. Between the upper 1 and the lower mat 40 hollow spaces 57 are formed, which serve as ventilation channels.

Figure 13:
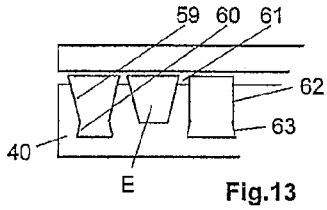

FIG. 13: This figure also shows a mattress in side view, into whose lower base mat sectional elements E have been inserted. The cross-section of the sectional elements in the first two examples is tapered upwards 59 as well as downwards 60. The shapes of the recesses are identical. In this way the elements are held fast in the recesses. Since the elements protrude from the base mat also in this case, ventilation channels 61 are formed between the upper and lower layer. A further example shows an element with rectangular cross-section 62, which flares outwards only at its lower end 63.

Figure 14:
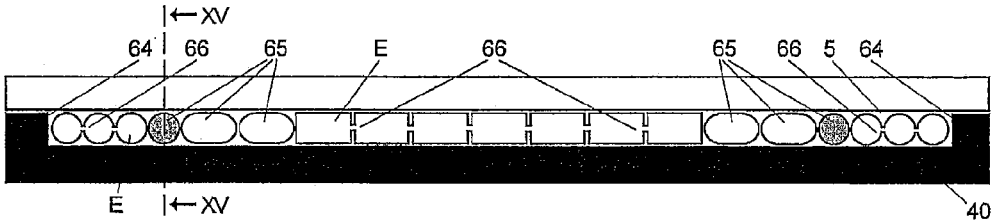
FIG. 14 is a longitudinal section of a mattress with a sectional element mat according to the invention.

FIG. 14: This figure shows a mattress in longitudinal section, whose base mat 40 has boundary elements 64 at both ends, for instance elevated steps, which enclose the sectional elements E lying behind them. The height of the boundary elements 64 is identical with the height of the sectional elements, in order to keep the upper layer uniformly plane. The figure shows sectional elements which are loosely placed side by side (position 65), as well as sectional elements at position 66 which are connected by means of a thin material bridge 5.

Figure 15:
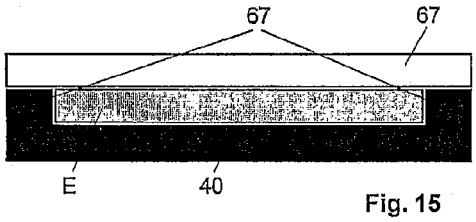
FIG. 15 is the mattress of FIG. 14 in a section along line XV-XV of FIG. 14.

FIG. 15: This figure shows a mattress in cross-section, whose lower base mat 40 has boundary elements 67 on both sides, for instance elevated steps, which enclose the sectional elements E. The height of the elevations is identical with the height of the sectional elements, to keep the upper layer uniformly plane.

Figure 16:
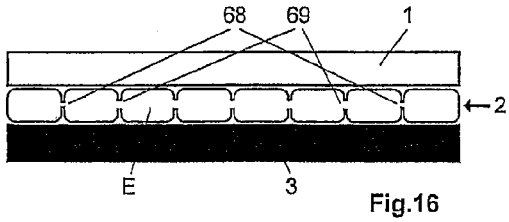
FIG. 16 is a variant of the mattress of FIG. 15.

FIG. 16: This figure shows a mattress in cross-section with an upper layer 1 and a lower layer 3 and an interposed sectional element mat 2. The subdividing of sectional elements E in the transversal direction of the mattress can be seen. In this example they are connected via perforations 68, 69. There can also be seen a thinner perforation 68 connecting the peripheral element to the adjacent inner element, while all other inner elements are connected via thicker perforations 69.

Figure 17:
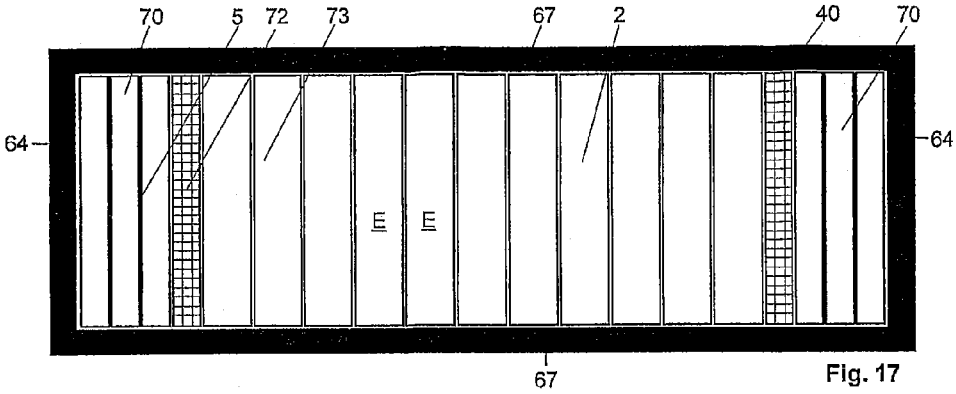
FIGS. 17 to 19 are diverse variants of sectional element mats according to the invention in a view from above.

FIG. 17: This figure shows in a view from above a sectional element mat 2 whose sectional elements E essentially extend over the whole width of the sectional element mat 2. They are enclosed by elevations 64, 67, which are attached at the edges of the underlying base mat or are formed as integral parts of the base mat. The first elements in positions 70 are connected via perforation 5, the other elements in positions 72, 73 are loosely packed side by side.

Figure 18:
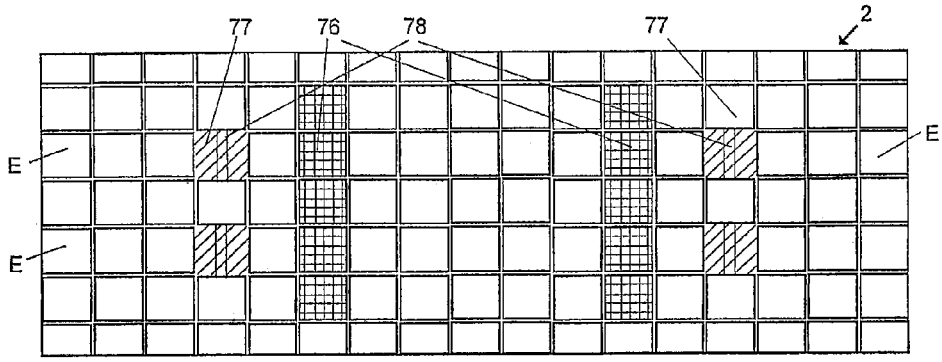

FIG. 18: This figure shows in a view from above a sectional element mat 2, which is subdivided in transversal as well as in longitudinal direction and whose sectional elements E are plugged into the underlying base mat. Sectional elements can be discerned which have been replaced by elements 76 with different material characteristics. There can also be seen regions where sectional elements have been removed and an empty space 77 remains. At these sites the plug-in grooves 78 provided in the underlying base mat can be seen. Instead of the plug-in grooves a pin-and-hole connection for the sectional elements E is possible.

Figure 19:
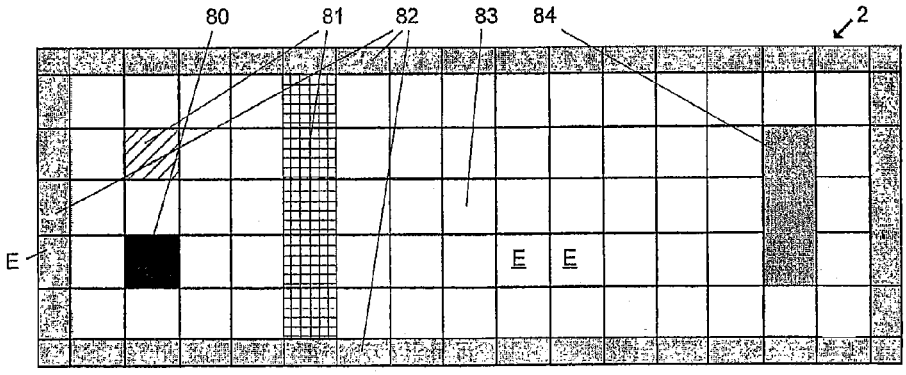

FIG. 19: This figure shows in a view from above a sectional element mat 2 whose sectional elements E are connected via perforation. The subdivided structure of the sectional elements in longitudinal as well as in transversal direction can be seen. Individual elements have again been replaced by elements 81, 84 with different material characteristics. Other elements have been removed and leave an empty space 80. The grey shading at the periphery 82 indicates the edge zone. To keep the edge of the mattress firm and stable no sectional elements are removed in this area. In this case sectional elements are exchanged only in the area interior to the edge zone, that is in the white area, by cutting the perforation.

Figure 20:
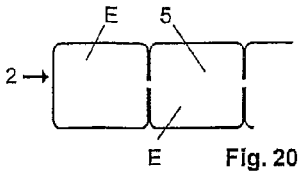
FIGS. 20 to 22 are sectional views of variants of the sectional element mat according to the invention.

FIG. 20: This figure shows a mattress which consists of a sectional element mat 2 only, where the individual sectional elements E are joined by a thin material bridge or a perforation 5.

Figure 21:
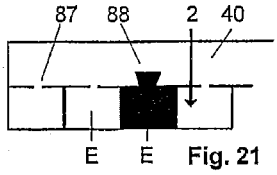

FIG. 21: This figure shows a mattress which is formed by a sectional element mat 2. In this case the base mat 40 is placed on top and the individual sectional elements E are in one example plugged into its underside (see 88) and in the other examples joined to the underside via perforation 87.

Figure 22:
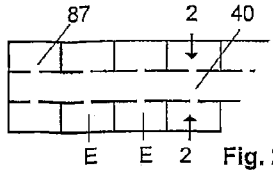

FIG. 22: This figure shows a variant of the embodiment according to 21 with sectional element mats 2, 2' placed on both sides of the base mat 40.

Figure 23:
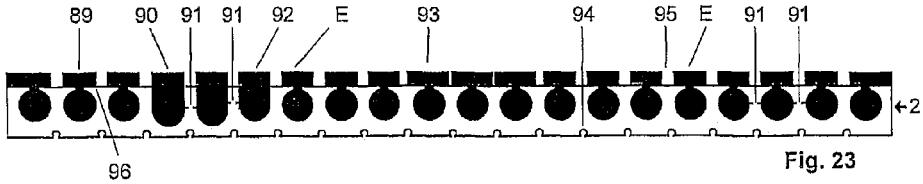
FIGS. 23 to 25 are sectional views of a further variant of the invention.

FIG. 23: This figure shows a variant of the embodiment according to FIG. 9 or 10, in which sectional elements 89, 90, 92 and 93 are plugged into a base mat 40. One can see stamp-shaped sectional elements 89, 93 and elements with straight side faces (see 90, 92). It can also be seen that the height of individual sectional elements 90, 92 may be different. Between some of the sectional elements perforations are provided in the form of cuts 91 in the material webs. The sectional elements 93 show a broader stamp. On the underside of the base mat 40 transverse grooves 94 and/or longitudinal grooves may be formed.

Figure 24:
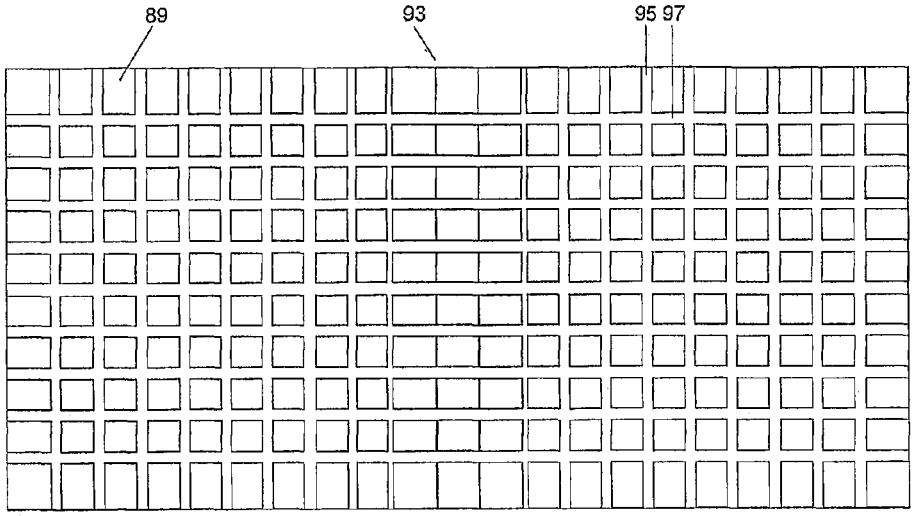

FIG. 24: This figure shows a view from above of the variant according to 23. One sees the stamps, which protrude from the base mat and form transversal grooves 95 of different width between the individual sectional elements, which grooves serve as ventilation channels. One also sees ventilation grooves 97 in longitudinal direction of the mat, which are worked into the surface of the sectional elements and form small cubes or stamps. There are also sectional elements 93 whose stamps are broader; in this case no ventilation channels are opened in transversal direction.

Figure 25:
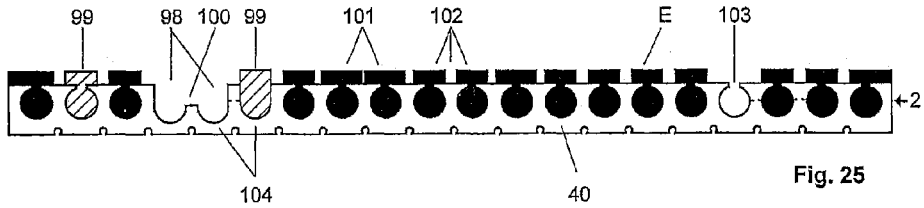

FIG. 25: This figure shows a side view as in 23 with some of the sectional elements having been removed at sites 98, 100, 103 and some sectional elements 99 having been replaced by others. One sees stamp-shaped sectional elements whose stamps are broader (see 101) and others whose stamps are less broad (see 102).

Figure 26:
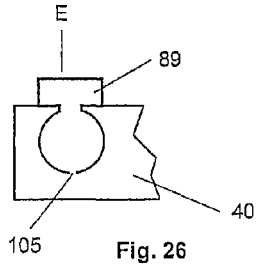
FIG. 26 is a detail of the variant of FIG. 23.

FIG. 26: This figure shows a detail of 25. One sees at the bottom of the sectional element (E) a material bridge 105, which holds together the stamp and the base mat 40.

An essential characteristic of the present invention is the close arrangement of the individual supporting or sectional elements E. They are arranged side by side with little or no intermediary spacing and form in this way the sectional element mat 2. The serial arrangement of the sectional elements E is either carried out only in longitudinal direction (e.g. 17) or in both directions (e.g. 18 and 19), that is in longitudinal as well as transversal direction of the mattress. The individual sectional elements are loosely placed one beside the other or are mutually connected. Connection is realised either in the form of a plug-in connection of the sectional elements E (FIGS. 4, 6, 7), or by sticking the elements onto or into a base mat (9 to 13), or by joining the elements via a material bridge or perforation (e.g. FIGS. 1, 2, 5).

Description of the plug-in connection: the material of the mattress is cut in such a way that one end of a sectional element may be hooked onto or plugged into the end of the adjacent element. The contact surfaces of the plug-in connection are either straight (27, 31) or tapered (28, 33) or furnished with a round thickened head 30, 34. In the last two variants the thickened part produces a lock effect, such that the connection can only be opened by a fairly strong tug. The mutually hooked or plugged sectional elements form a sectional element chain—if they are subdivided only in the longitudinal direction of the mattress—or a sectional element net, if they are subdivided in longitudinal as well as transversal direction of the mattress. This kind of arrangement permits the removal of each individual sectional element by opening the hooking or plugging connection and the replacement of the element by another one of different firmness. In this way the supporting force of the mattress may be adjusted at any point desirable. It is also possible to exchange or completely remove individual elements only in the interior region of the mattress. In this way the supporting structure of the mattress may be individually tailored also in the transversal direction of the mattress. For persons sleeping on their backs the supporting force of the mattress may thus be increased in the central area of the shoulder region, while softer zones are provided in the lateral regions to permit settling of the shoulders if a side position is assumed. The region of the mattress edges will however remain firm and stable as long as the extreme peripheral elements of the sectional element net are left in place (see 19, edge zone 82). According to one variant, it may also be provided that the sectional elements are not connected to each other but plugged onto a base mat 40 (see FIGS. 9 to 13).

Description of perforation: in this case the individual sectional elements E are mutually connected via perforation (see for instance 1). Perforation is obtained by cutting one sectional element after the other from the mattress material. The cut is, however, not carried out completely, but leaves intact a small material bridge 5, 6 to the next sectional element—a kind of perforation which may be torn easily if the sectional elements are to be separated from each other. In case the mattress is subdivided into sections only in longitudinal direction this will result in individual ribs which may be separated by tearing off the perforation and may be replaced by other—softer or firmer—sectional elements. In the case of sectionalisation in both directions, there results a multitude of small, wafer-shaped sectional elements E. These may be removed in any desired formation and may also be replaced by other—softer or firmer—elements.

There exists also the option not to replace removed individual elements and to leave the vacated area empty (see e.g. position 12 of 3). In this way, better settling of the shoulder region may be achieved.

The sectional element mat 2 may be used in the form of a single-layer mattress. Preferably, however, sectionalisation technology is used with two or more layers 1, 3, one laid onto the other. Furthermore, there is the possibility to combine several sectional element mats (see 5 or 8).

A combination of a sectional element mat 2 with another sectional element mat 2' or with other mattress layers results in a multi-layer mattress. Preferably the mattress consists of three or four single layers, with the uppermost one or two layers being, for instance, continuous mats 21, 22 (5) made of softer material. This provides soft bedding for the sleeper. In many cases the bottom layer 3 is also continuous, i.e. not sectionalised. It is made of firmer material and has supporting function. Between these two layers at least one sectional element mat 2 is provided, whose task it is to provide individual regulation of support by replacing individual sectional elements. In a three-layer mattress it also makes sense to use a sectional element mat 2 for both middle and bottom layers. The overall thickness of the mattress can thereby be reduced while extensive support regulation is still achievable. The upper sectional element mat can thus serve to ensure soft bedding of certain parts of the body, e.g. the pelvic region, while the lower sectional element mat gives increased support to the body, such that the pelvis as a whole will not sink in too deeply.

The elements of a sectional element mat may also be loosely arrayed. In this case an underlying base mat is preferably used.

A variant (2) provides that this lower base mat has elevations 8 on its top face, which protrude into the interstices between the individual overlaid elements or between the elements of the overlaid sectional element mat, in order to hold these elements in place. Such elevations can also be provided on the underside of an overlaid mat in order to fill in interstices between sectional elements with rounded surface.

A further variant provides that the base mat 40 has thickened strips extending upwards in the form of elevated steps 64, 67 (FIGS. 14, 15) at the sides or additionally also at the head and foot end. The upward extension of these steps is such that the elements of the laid-on sectional element mat(s) or the individually laid-on elements are framed in their full height. This results in a firm boundary of the sectional element mat or of the single elements on the sides as well as at the head and the foot end. The sectional element mat or the loose single elements are placed in the remaining free space within the boundary. In the case of sectional element mats with wafer-shaped elements (19), this boundary results when individual elements in the interior of the mat are removed from the perforation and replaced by others, while the elements in the edge region are left connected via the perforation and thus form a boundary for the interior, loose elements. Here the perforation between the edge elements and adjacent interior elements is preferably thinner than the perforation joining the interior elements. This has the effect that whole ribs contained between the lateral boundaries may be easily removed.

The individual sectional elements of the sectional element mat cannot only be horizontally connected to each other by means of a plug-in connection or via perforation, but can also be vertically fixed in position by an underlying base mat 40 or by yet another sectional element mat. In this respect the invention proposes two kinds of connection:

1. Plug-in connection: The individual elements are plugged into recesses of the underlying base mat. They may be taken out and replaced by other elements. Preferably the cross-sections of such sectional elements and of the corresponding recesses are inwardly bent or constricted such that the elements are gripped in the recesses. The sectional elements plugged into the recesses protrude beyond the top plane of the base mat, forming small hollow spaces between the sectional elements, which serve as ventilation channels.

2. Perforation connection: The elements are connected by means of a material bridge (perforation). That is, by a narrow material joint which can easily be torn apart, to an underlying base mat or another sectional element mat. Connecting the elements to another sectional element mat gives the opportunity to remove and replace two stacked elements or to leave the vacated space empty.

At certain positions of the layers, either continuous layers or sectional element mats, transversal chambers 4, 9 are provided. If material is removed from these chambers, the sleeper will be settled more comfortably in the mattress in these places. In combination with the regulating options of the sectional element technology, this will permit sinking-in of the shoulders with ample space even for very broad shoulders.

A particularly preferred application of the sectional mat is based on the plug-in connection described above, i.e. a base mat 40 into which are plugged transversally extending sectional elements E (FIGS. 23 to 26). The cross-section of the sectional elements E varies depending on the function that the sectional element mat has to fulfil at the respective position. The preferred basic element has the shape of an upside-down stamp 89. This shape of cross-section is based on the principle of gripping as described above, which means that the cross-section of the sectional elements E has indented sides that lock with corresponding outward bulges of the surrounding material of the base mat 40, resulting in a firm grip 96 by the base mat 40, which holds the sectional elements in place. The cylindrical shape of the lower part of the sectional elements gives rise to a well-defined indentation, which keeps the sectional element securely in place.

The stamp 89 forming the upper part of the element extends beyond the base mat 40. As a consequence there are formed not only transversal channels 95 between the individual sectional elements, which serve as ventilation channels for the mattress, but there is also created a squeeze zone, which offers space for material expansion when pressure is applied from above and which gently buffers the lying-down pressure. It is preferred deepened grooves 97 are also cut in longitudinal direction of the mat, creating a kind of cubical structure which will buffer in all directions and thus increase the effect. A further advantage of the stamp-like shape lies in the choice of different stamp widths permitted by the invention. In places where a stronger supporting force of the mattress is desired sectional elements with stamps 93, 101 of greater width are used, while stamps of smaller width 89, 102 are used where less supporting force is desired. Preferably sectional elements with different stamp widths are already provided when the mat is produced, which will permit pressure zone adjustment of the mattress by simply exchanging sectional elements with wide stamps 101 against elements with narrow stamps 102. If greater pressure differences are to be realized, sectional elements are replaced by others which are made from firmer or softer material (see 99 in 25). The invention also provides that individual sectional elements 98, 100, 103 are removed from the base mat 40 without replacement. In this way extremely soft zones are realised, which are suitable for defined users, if optimum settling of the shoulder or the creation of sink-in zones 103 for the knee is required. In order to be able to further increase the sink-in effect in shoulder zones, the invention provides two further application techniques. In the shoulder region there are optionally imbedded in the base mat 40, sectional elements 90, 92 with straight sides or only slight indentations 58 (see FIG. 12). In this way less material will remain in the base mat when sectional elements are removed, and more space will become available for the sinking-in of shoulders. A similar effect is achieved by reducing the height of the webs between the sectional elements. This is achieved by providing that via a perforation 91, the upper part of the web can be torn from the lower part. The perforation is realised by a cut from each side, which leaves only a small material bridge, i.e. the perforation.

Different sizes may be chosen for the individual sectional elements E of a sectional element mat 2, which will result in different insertion depths in the base mat 40, as shown in position 90, 92 of 23. An increased sinking-in effect can thus be obtained, for instance, in the shoulder region. The invention also provides the possibility of connecting each single sectional element via a perforation, i.e. by a small material bridge 105, to the base mat 40 (see A FIG. 26) and to break this material bridge only when the sectional element is to be removed. This has the advantage that sectional elements will not pop out of their place when the material is handled during the manufacturing process.

The invention claimed is:

1. A sectional element mat comprising a base mat having an upper surface with transversely extending channels across a width of the base mat, the channels having cross sections, wherein the base mat has partition walls between the channels at least one of the partition walls has a perforation, and at the perforation thus formed the partition walls can be adjusted in height by tearing off an upper part of the partition wall, an array of sectional elements, the sectional elements having a lower part including a protrusion having a cross section complementary to the cross section of the channels to allow insertion of the protrusion of the sectional element into the channel, the sectional element also having an upper pad component that is positioned on the upper face of the base mat when the protrusion of the sectional element is inserted into a channel so that the sectional elements are connected to the base mat in an easily separable way.

2. A sectional element mat according to claim 1, wherein one or more sectional element mats form a mattress or, in combination with other continuous layers, which are placed above or below the sectional element mat, form a multi-layer mattress.

3. A sectional element mat according to claim 1, wherein sectional elements are removable from the array of elements of the sectional element mat and the resulting empty space may be filled with sectional elements of other material properties or may remain empty.

4. A sectional element mat according to claim 1, wherein ones of the upper pad components protruding from the base mat have different widths in cross-section in certain zones of the mat, giving rise to transversal grooves of differing width between adjacent sectional elements and thus influencing the pressure absorbing capability of the sectional element mat in chosen zones.

5. A sectional element mat according to claim 1, wherein gaps exist between the upper pad components of the sectional elements on the upper face of the base mat to provide ventilation grooves at the surface of the sectional element mat.

6. A sectional element mat according to claim 1, wherein the protrusion of a sectional element is connected to the base mat on its underside by means of a small material bridge.

7. A sectional element mat according to claim 1, wherein the protrusion has a cylindrical cross section.

8. A sectional element mat according to claim 1, wherein individual sectional elements are placed one beside the other within a channel.

9. A sectional element mat according to claim 1, wherein protrusions of individual ones of the sectional elements have a neck portion below the pad component that is narrower than a maximum width of the protrusion and at least one channel in the base mat has margins that approach each other and are closer to each other than a maximum width of the channel to fit against the neck of an inserted protrusion.

* * * * *